US008750741B2

(12) United States Patent
Do

(10) Patent No.: US 8,750,741 B2
(45) Date of Patent: Jun. 10, 2014

(54) IMAGE FORMING APPARATUS, IMAGE PROCESSING SYSTEM HAVING THE SAME, AND METHOD FOR PERFORMING RESERVATION JOB OF THE IMAGE FORMING APPARATUS

(75) Inventor: Tae-hoi Do, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 535 days.

(21) Appl. No.: 12/265,210

(22) Filed: Nov. 5, 2008

(65) Prior Publication Data

US 2009/0148178 A1 Jun. 11, 2009

(30) Foreign Application Priority Data

Dec. 10, 2007 (KR) ..... 10-2007-127712

(51) Int. Cl.
*G03G 15/00* (2006.01)

(52) U.S. Cl.
USPC ..... 399/83; 399/19; 399/76; 399/87

(58) Field of Classification Search
USPC ..... 399/16, 18, 19, 75–77, 81, 82, 85, 87
See application file for complete search history.

(56) References Cited

U.S. PATENT DOCUMENTS

| | | | | |
|---|---|---|---|---|
| 7,657,753 | B2 | 2/2010 | Sawada | |
| 2002/0031364 | A1 * | 3/2002 | Suzuki et al. | 399/75 |
| 2004/0170443 | A1 * | 9/2004 | Maeshima | 399/82 |
| 2005/0214017 | A1 * | 9/2005 | Isobe et al. | 399/82 |
| 2006/0083533 | A1 * | 4/2006 | Maeshima | 399/82 |

FOREIGN PATENT DOCUMENTS

| | | |
|---|---|---|
| JP | 2004-110740 | 4/2004 |
| JP | 2005-242781 | 9/2005 |
| JP | 2005-262864 | 9/2005 |
| JP | 2006-103151 | 4/2006 |
| KR | 10-0574019 | 4/2006 |

OTHER PUBLICATIONS

Korean Office Action dated Apr. 26, 2012 issued in corresponding Korean Patent Application No. 10-2007-0127712.

* cited by examiner

*Primary Examiner* — Walter L Lindsay, Jr.
*Assistant Examiner* — Jessica L Eley
(74) *Attorney, Agent, or Firm* — Staas & Halsey LLP

(57) ABSTRACT

A method for performing a reservation job of an image forming apparatus includes: selecting the kinds of jobs to be reserved as job data; setting a time for starting and a period for performing the job reserved as the job data; and performing the selected job reserved as the job data at the set time and period.

25 Claims, 4 Drawing Sheets

IMAGE FORMING APPARATUS, IMAGE PROCESSING SYSTEM HAVING THE SAME, AND METHOD FOR PERFORMING RESERVATION JOB OF THE IMAGE FORMING APPARATUS

CROSS-REFERENCE TO RELATED APPLICATIONS

This application claims benefit of Korean Patent Application No. 2007-127712, filed on Dec. 10, 2007 in the Korean Intellectual Property Office, the disclosure of which is incorporated herein by reference.

BACKGROUND OF THE INVENTION

1. Field of the Invention

Aspects of the present invention relate to an image forming apparatus, an image processing system having the same and a method for performing a reservation job of the image forming apparatus, and more particularly, to an image forming apparatus which performs a reserved job periodically, an image processing system having the same, and a method for performing a reservation job of the image forming apparatus.

2. Description of the Related Art

In general, an image forming apparatus forms a visible image on a printing medium based on a provided image data. The image forming apparatus may be a printer, a facsimile, a digital copier, a multifunction device, etc. Here, the multifunction device performs at least printing, scanning, and facsimile functions. As an example of a conventional image forming apparatus, the multifunction device may have a reservation function for printing, scanning, and facsimiling jobs.

If a user uses the reservation function for such jobs as printing, scanning, and facsimiling, it is necessary to set a reservation job, such as select a job to be reserved and set a time of performing the reserved job, each time the user uses the reservation function, i.e., the reserved job and the performance time of the reserved job become null after one use. Thus, after the reserved job is performed, information about the reserved job is reset.

Accordingly, if a user wishes to reserve the job to be performed periodically, such as daily or weekly, the user must periodically set up the reservation job.

SUMMARY OF THE INVENTION

Aspects of the present invention provide an image forming apparatus, which periodically performs a reserved job, such as fax sending, e-mail sending, and printing, an image processing system having the same, and a reservation job performing method of the image forming apparatus. Additional aspects of the present invention will be set forth in part in the description which follows and, in part, will be obvious from the description, or may be learned by practice of the present invention.

According to aspects of the present invention, a method for performing a reservation job of an image forming apparatus, includes: selecting a kind of job among a plurality of different kinds of jobs to be reserved as job data; setting a time for starting and a period for performing the job reserved as the job data; and performing the selected job reserved as the job data at the set time and period.

According to aspects of the present invention, the method may further include storing the job data to be performed at the set time according to the set period.

According to aspects of the present invention, the storing of the job data may include storing the job data in at least one of the image forming apparatus, a portable storage medium connected to the image forming apparatus and a host connected to the image forming apparatus.

According to aspects of the present invention, the storing the job data may include storing the reserved job data in folders according to the plurality of different kinds of jobs.

According to aspects of the present invention, the setting of the time for starting and the period for performing the reserved job may include setting the time for starting and the period for performing the reserved job individually with respect to the folders storing the job data.

According to aspects of the present invention, the kinds of jobs stored in the folders may include at least one of sending a fax, sending e-mail, and printing.

According to aspects of the present invention, the method may further include: setting detailed information according to the kinds of jobs.

According to aspects of the present invention, at least one of the image forming apparatus, the portable storage medium, and the host checks the detailed description and the kind of job assigned to the folder through an attribute file stored in the folder, and performs the reserved job according to the kind of job and the detailed information.

According to aspects of the present invention, at least one of the selecting the kinds of job, the setting the time for starting and the period for performing the reserved job, and the setting the detailed information may be performed through a user interface provided in the host.

According to aspects of the present invention, the method may further include authenticating a user to allow only the authenticated user to select the kinds of job and to set the time for starting and the period for performing the reserved job.

According to aspects of the present invention, an image forming apparatus includes: a job selecting unit to select the kinds of jobs to be reserved as job data; a period setting unit which to set a time for starting and a period for performing the job reserved as the job data; a controller to control the selected job reserved as the job data to be performed at the set time; and a storing unit to store the job data.

According to aspects of the present invention, the storing unit may store the job data in a folder in at least one of the image forming apparatus, a portable storage medium connected to the image forming apparatus, and a host connected to the image forming apparatus.

According to aspects of the present invention, a plurality of folders may be provided plurally to respectively store the job data according to the kinds of jobs.

According to aspects of the present invention, the period setting unit may set the time for starting and the period for performing the reserved jobs according to the plurality of folders, respectively.

According to aspects of the present invention, the kinds of job to be selected and stored in the folders by the job selecting unit may include at least one of sending a fax, sending e-mail and printing.

According to aspects of the present invention, the apparatus may further include: a detailed information setting unit to set detailed information according to the kinds of jobs.

According to aspects of the present invention, the apparatus may further include: a user authenticating unit to authenticate a user to allow only the authenticated user to select the kinds of jobs and to set the time for starting and the period for performing the reserved job.

According to aspects of the present invention, an image processing system, may include: an image forming apparatus; and a host to control the image forming apparatus.

According to aspects of the present invention, the storing unit may store the job data in a folder in at least one of the image forming apparatus, a portable storage medium connected to the image forming apparatus, and a host connected to the image forming apparatus.

According to aspects of the present invention, a plurality of the folders may be provided to respectively store the job data according to the kinds of job.

According to aspects of the present invention, the period setting unit may set the time for starting and the period for performing the reserved jobs according to the plurality of folders, respectively.

According to aspects of the present invention, the kinds of job to be selected and stored in the folders by the job selecting unit may include at least one of sending a fax, sending e-mail and printing.

According to aspects of the present invention, the image processing system may further include: a detailed information setting unit to set detailed information according to the kinds of jobs.

According to aspects of the present invention, the image processing system may further include a user authenticating unit to authenticate a user to allow only the authenticated user to select the kinds of jobs and to set the time for starting and the period for performing the reserved job.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following description of the exemplary embodiments, taken in conjunction with the accompanying drawings, in which.

DETAILED DESCRIPTION OF THE EMBODIMENTS

Figure 1:
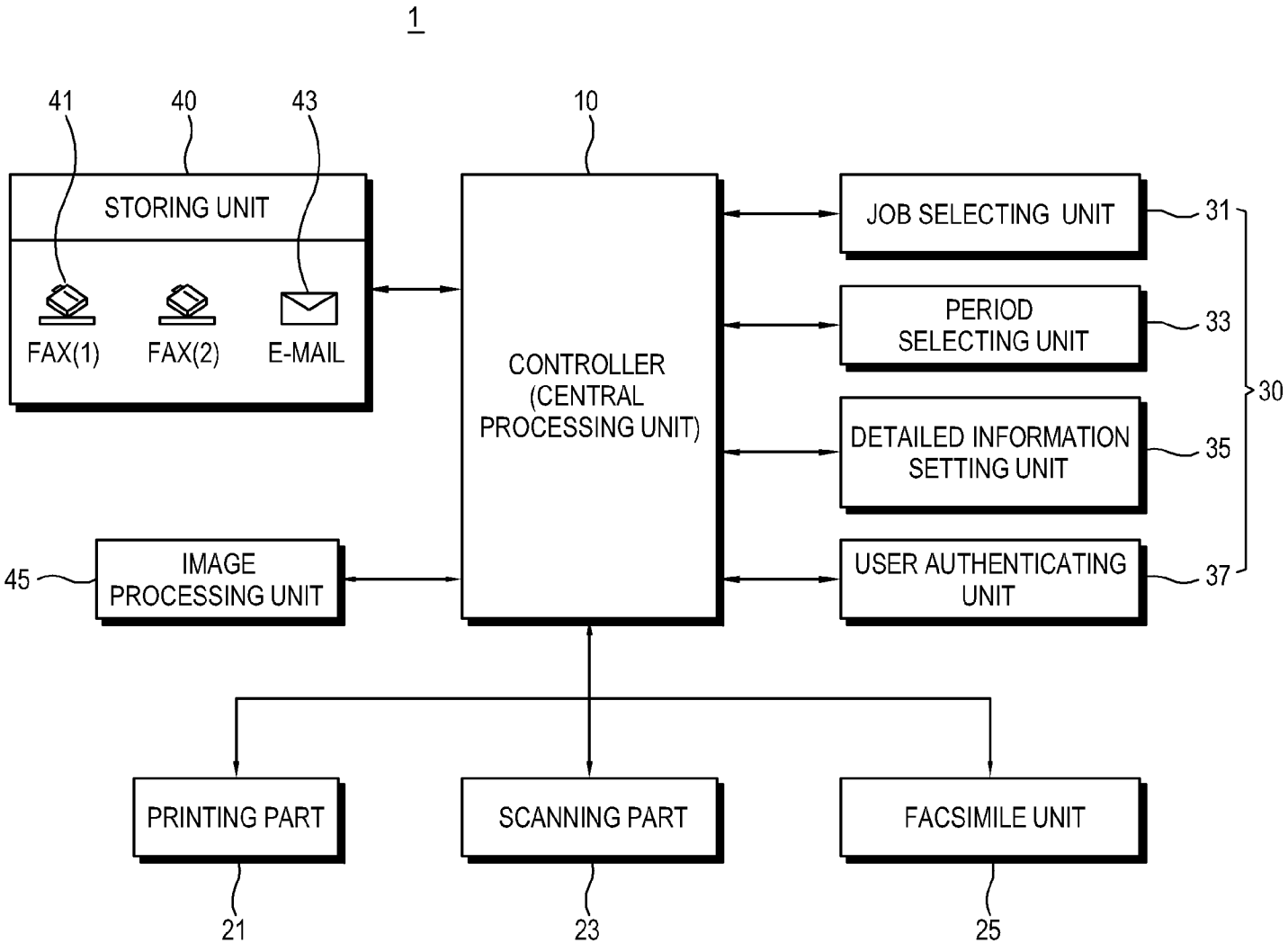
FIG. 1 is a block diagram illustrating an image forming apparatus according to an exemplary embodiment of the present invention.

Reference will now be made in detail to the embodiments of the present invention, examples of which are illustrated in the accompanying drawings, wherein like reference numerals refer to like elements throughout. The exemplary embodiments are described below so as to explain the aspects of the present invention by referring to the figures.

FIG. 1 is a block diagram illustrating an image forming apparatus according to an exemplary embodiment of the present invention. Referring to FIG. 1, an image forming apparatus 1 includes a control unit (central processing unit) 10 to generally control the elements of the image forming apparatus 1, a printing part 21 to print an image, a scanning part 23, a reservation setting unit 30, and a storing unit 40. Also, the image forming apparatus 1 may include a facsimile unit 25 to transmit and receive data.

The printing part 21 prints image data on a printing medium fed from a medium feeding unit (not shown) and discharges the printing medium through a medium discharging unit (not shown).

The scanning part 23 optically reads an image from a document and converts the read image to the image data. The image data is stored in the storing unit 40 as a file. Detailed descriptions of the printing part 21 and the scanning part 23 will be described below.

The storing unit 40 stores a file to be transmitted to the printing part 21 or the like. The storing unit 40 may be provided in at least one of the image forming apparatus 1, a portable storage medium which can be connected to the image forming apparatus 1, and a host which can be connected to the image forming apparatus 1. The host may include a server or personal computer, which can control the image forming apparatus 1 in addition to the control unit 10. The storing unit 40 may be provided as a memory element or a hard disk and may have folders to maintain and manage the stored file. Also, the storing unit 40 may store job data to be reserved. Here, the job data is stored as a file in at least one folder provided in the storing unit 40.

The reservation setting unit 30 is provided to reserve jobs for operations of the printing part 21, the scanning part 23, and the facsimile unit 25, and the reservation setting unit 30 may include a job selecting unit 31 and a period/time selecting unit 33. The job selecting unit 31 selects a job to be reserved with regard to at least one of the job data stored in the folder. Here, the job to be reserved may include facsimiling, sending an e-mail, printing, and so on.

The folder in the storing unit 40 may include a plurality of folders as illustrated in FIG. 1. In this case, the plurality of folders are set according to the kind of job to be reserved, respectively. The kinds of jobs, which are assigned to the folders by the job selecting unit 31, may include at least one of transmitting a facsimile, sending an e-mail, and printing.

For example, referring to Tables 1 and 2, the job of fax sending may be assigned to a first folder 41 which is designated "FAX(1)," and the job of e-mail sending may be assigned to a second folder 43 which is designated "e-mail." Further, a fax number, and the period, and the time (to be described later) are set with regard to the first folder 41 and/or the second folder 43.

TABLE 1

| Item | Value |
|---|---|
| folder name | FAX(1) |
| period/time | 1_Day/11:30 PM |
| job | Fax_Sending |
| Other fax information | |
| fax number | 1234567 |
| . . . | . . . |

TABLE 2

| Item | Value |
|---|---|
| folder name | e-mail |
| period/time | Weekly/10:00 AM |

TABLE 2-continued

| Item | Value |
|---|---|
| Job | Email_Sending |
| Other e-mail information | |
| e-mail address | abc@defg.com |
| . . . | . . . |

The period/time selecting unit 33 sets the time for starting and the period for performing the reserved job. Referring to Table 1, one day is set as the period at the end of which the reserved job recurs, and 11:30 PM is set as the time for starting the reserved job. Here, a user can voluntarily set the period for performing the reserved job by selecting two days, a week, a month, etc., as well as the one day.

Further, in the case that the plurality of folders are provided in the storing unit 40, the period/time selecting unit 33 may set the time for starting and the period for performing the reserved job individually with regard to each folder.

Accordingly, it is convenient for a user because the kinds of jobs, and the time and period for the reserved job are set individually according to the plurality of folders.

Further, the image forming apparatus according to this embodiment may additionally include a detailed information setting unit 35 to set detailed information according to the kinds of jobs. The detailed information to be set via the detailed information setting unit 35 for facsimile jobs may include information about a fax mode, a transmission resolution, retransmission times if an error occurs, etc. The detailed information to be set via the detailed information setting unit 35 for the job of sending e-mail may include information about a file format, an attached file, a carbon copy e-mail address, etc. The detailed information to be set detailed information setting unit 35 for the job of printing may include information about color or monocolor printing, the number of printing pages, selection of a paper tray, etc.

In addition, whether the reserved job is removed from the folder after the reserved job, such as the fax sending, the e-mail sending, or the printing, is completed normally may be set via the detailed information setting unit 35 as the detailed information.

The detailed information set by the detailed information setting unit 35 may be stored as an attribute file in the corresponding folder. Thus, the detailed information of the job to be reserved can be set through the controller 10 when the periodic jobs are reserved corresponding to the folders, respectively.

Further, the image forming apparatus according to this embodiment may additionally include a user authenticating unit 37. The user authenticating unit 37 allows only a user having authority to select the kinds of jobs to set the time for starting and the period of performing the reserved job and to set the detailed information of the job to be reserved. In particular, a user may have an identification and a password to log on to the image forming apparatus 1.

The controller 10 generally controls the image forming apparatus 1 according to a preset program. For example, the controller 10 controls an image processing unit 45 to process image data input from the host through an interface or scanned by the scanning part 23; the scanning part 23; the printing part 21; and the reservation setting unit 30.

When the job data is stored in the storing unit 40, the controller 10 controls the stored job data to perform the reserved job at the starting time every period set by the period/time selecting unit 33. At this time, the controller 10 checks the kinds of jobs and the detailed information with reference to the attribute file of the detailed information stored in the corresponding folder, and thus performs the reserved job according to the detailed information.

In the image forming apparatus having the reservation function with this configuration, the reserved job, which is selected for the job data (file) stored in the folder of the storing unit 40, may be repeated periodically. For example, if the image forming apparatus is connected to and has to periodically send a fax to a predetermined receiver through a communication line, a user only moves the file for the fax to the folder of which the kind of job is set as the fax sending, so that the fax can be sent each period at the set time, thereby increasing convenience to a user.

Figure 2:
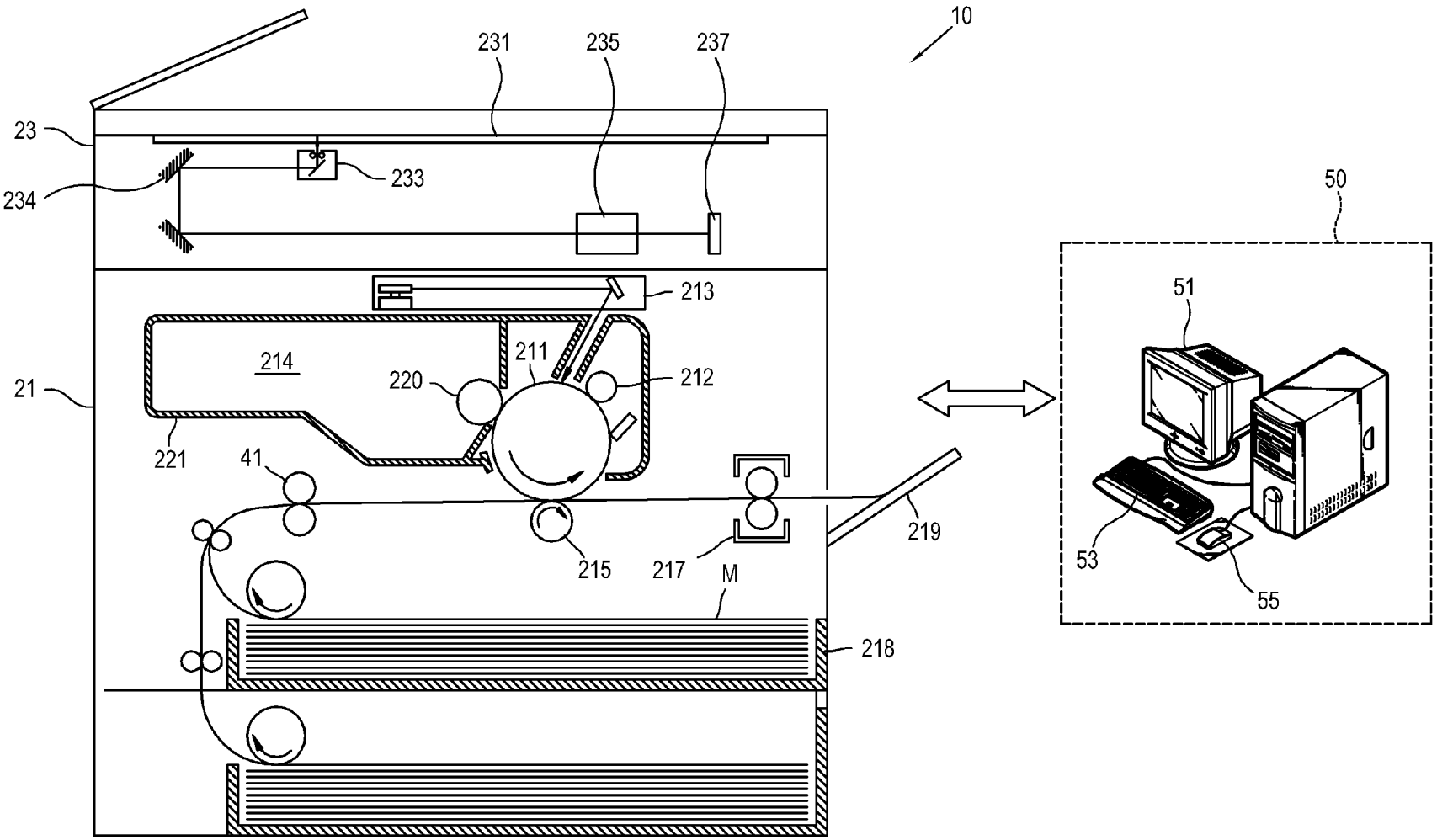
FIG. 2 is a schematic view illustrating an image processing system according to an exemplary embodiment of the present invention.

FIG. 2 is a schematic view illustrating an image processing system according to an exemplary embodiment of the present invention. As illustrated in FIG. 2, the image processing system includes the image forming apparatus 1 and a host 50 connected to the image forming apparatus 1. The image forming apparatus 1 and the host 50 may be connected to each other through a serial bus, a parallel bus, a wired or wireless network, or the like. The host 50 applies a printing order to the image forming apparatus 1, and the image forming apparatus processes image data to form an image on a printing medium M.

The image forming apparatus 1 is similar to the above-mentioned image forming apparatus 1, and hence repetitive descriptions thereof will be avoided.

Referring to FIG. 2, the printing part 21 prints an image on a printing medium M by an electro-photographic method, a medium feed unit 218 to supply the printing medium M to the image forming unit 210. The printing part 21 includes a photosensitive body 211, a charger 212, an exposure unit 213, a development unit 214, a transfer unit 215, and a fusing unit 217.

An image forming process of the printing part 21 will be described as follows. First, the photosensitive body 211 is uniformly charged with an electric potential by the charger 212. If the photosensitive body 211 is scanned by a light signal from the exposure unit 213 corresponding to the image data, an electro-static latent image is formed on the photosensitive body 211 as an electric potential level of a part scanned by the light beam is decreased. Subsequently, a development bias voltage is applied to a development roller 220, so that a toner (not shown) from a toner container 221 is attached to the electrostatic latent image on the photosensitive body 211, thereby forming a toner image on the photosensitive body 211.

Further, the printing medium M drawn out from the medium feed unit 218 is transported to the image forming unit 210.

An arrival of the printing medium M to a transfer nip between the photosensitive body 211 and the transfer unit 215 is adjusted so that a leading edge of the toner image formed on the photosensitive body 211 also arrives at the transfer nip. Accordingly, if a transfer bias voltage is applied to the transfer unit 215, the toner image is transferred from the photosensitive body 211 to the printing medium M. After the printing medium with the toner image passes through the fusing unit 217, printing of an image is completed as the toner image on the printing medium M is fused by heat and pressure. Then, the printing medium M with the image formed thereon is discharged by a medium discharge unit 219.

The image forming apparatus 1 according to an exemplary embodiment of the present invention may include an ink-jet type image forming apparatus as an alternative to the above electro-photographic type image forming apparatus. The ink-jet type image forming apparatus may include a cartridge including an inkjet head, a carriage to transport the cartridge, and a carriage driving unit. Further, according to aspects of the present invention, the image forming apparatus 1 is not limited to the above description such that any image forming apparatus may be used, such as a double-pass image forming apparatus.

The scanning part 23 includes an illuminating unit 233 to illuminate a document or object to be scanned which is placed on a document tray 231, an image forming lens 235, and a sensor 237 to read image data of a document according to light reflected from the document on the document tray 231. The light illuminated from the illuminating unit 233 is reflected by the document and passes through the image forming lens 235, thereby forming an image on the sensor 237. The sensor 237 reads the image data from the document according to the image formed thereon.

Further, the scanning part 23 may additionally include a plurality of reflecting mirrors 234 provided between the document and the image forming lens 235. The plurality of reflecting mirrors 234 provides an optical path within a limited space of the image forming apparatus 1. The reflecting mirrors 234 change the optical path by reflecting the light reflected by the document.

In the present embodiment, the reservation setting unit 30 is used for setting the reservation job, such as selecting the kind of jobs to be reserved, the time and period for performing the selected job, and the detailed information, but the host 50 may alternatively be used. For example, a display 51 of the host 50 may display file information about the image forming apparatus 1 so that a user can set the reservation job using a keyboard 53 or a mouse 55.

Below, a method for performing a reservation job of the image forming apparatus according to an exemplary embodiment of the present invention will be described with reference to FIGS. 1 through 4.

Figure 3:
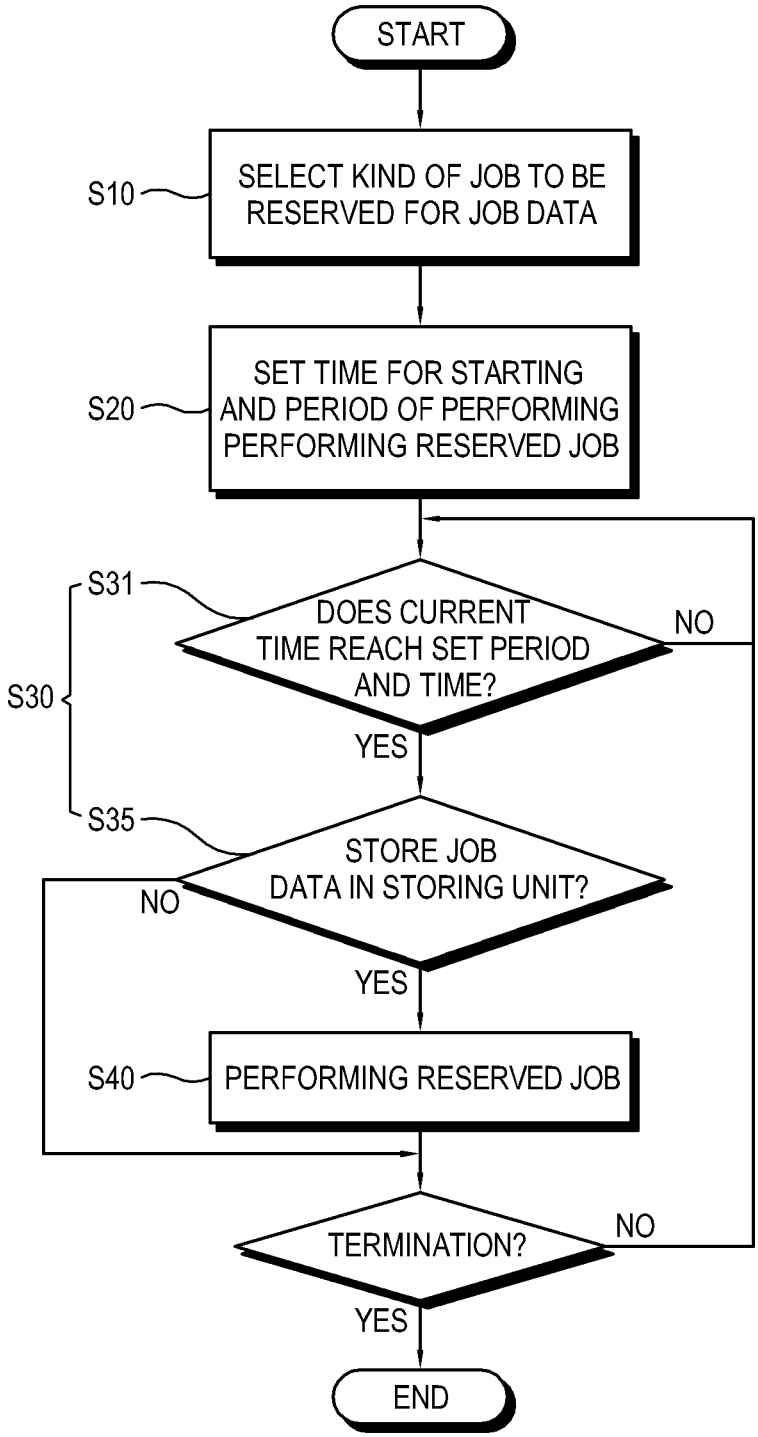
FIG. 3 is a flowchart illustrating a method for performing a reservation job according to an exemplary embodiment of the present invention.

FIG. 3 is a flowchart illustrating a method for performing a reservation job according to an exemplary embodiment of the present invention. Referring to FIGS. 1 through 3, the method according to an exemplary embodiment of the present invention includes selecting the kinds of jobs (S10); setting a time for starting and a period for performing the reserved job (S20); determining whether a predetermined condition is satisfied (S30); and performing the reserved job periodically if the condition is satisfied (S40).

The operations S10 and S20 for setting the conditions are achieved by a user's selection. In other words, the operations S10 and S20 are implemented in initially setting the reservation job, amending the reserved job, or reserving a new job. Consequently, the operations S10 and S20 are not needed while performing the reserved job periodically.

At the operation S10, a user selects the kinds of jobs which can be applied to the job data of the job to be reserved. According to an exemplary embodiment of the present invention, the method for performing the reservation job may further include storing the job data in the storing unit 40.

The storing unit 40 may be provided in at least one of the image forming apparatus 1, the host 50, and the portable storage medium (not shown). Here, the portable storage medium may be a storing medium which can be wirely or wirlessly connected to the image forming apparatus 1 or the host 50. For example, a hard disk, a personal digital assistant, a smart phone, a memory element, or the like may be used for the portable storage medium.

The storing unit 40 includes the folder in which the job data is stored in the form of a file. In more detail, the storing unit 40 includes the plurality of folders to which the kinds of jobs are assigned, respectively. Thus, in the operation of storing the job data, the job data may be stored in different folders according to the kinds of jobs. Here, the kinds of jobs set to the respective folders may include the facsimiling, the e-mail sending, and the printing.

In addition, the operation S10 may further include setting the detailed information of each kind of job. As examples of the detailed information, the detailed information for the job of facsimiling may include information about a fax mode, a transmission resolution, retransmission times at an error, etc.; the detailed information for the job of sending e-mail may include information about a file format, an attached file, a carbon copy e-mail address, etc.; and the detailed information for the job of printing may have information about color or monocolor printing, the number of printing pages, selection of a paper tray, etc.

In addition, as an example of setting the detailed information, it may be set whether the reserved job is removed from the folder after the reserved job, such as the fax sending, the e-mail sending, or the printing, is normally completed.

The operation of setting the detailed information may further include generating an attribute file involved in the detailed information and storing the attribute file in the corresponding folder. Thus, the image forming apparatus 1 or the host 50 checks the kinds of jobs and the detailed information with reference to the attribute file stored in the corresponding folder, and thus performs the reserved job on the basis of the kind of job and the detailed information.

Here, at least one of selecting the kinds of jobs; the time for starting and the period of performing the reserved job; and setting the detailed information may be performed through a user interface provided in the host 50 or the image forming apparatus 1.

Further, the method for performing the reservation job according to an exemplary embodiment of the present invention may further include authenticating a user, thereby allowing only a user having authority to select the kinds of jobs and to set the time for starting and the period of performing the reserved job.

Figure 4:
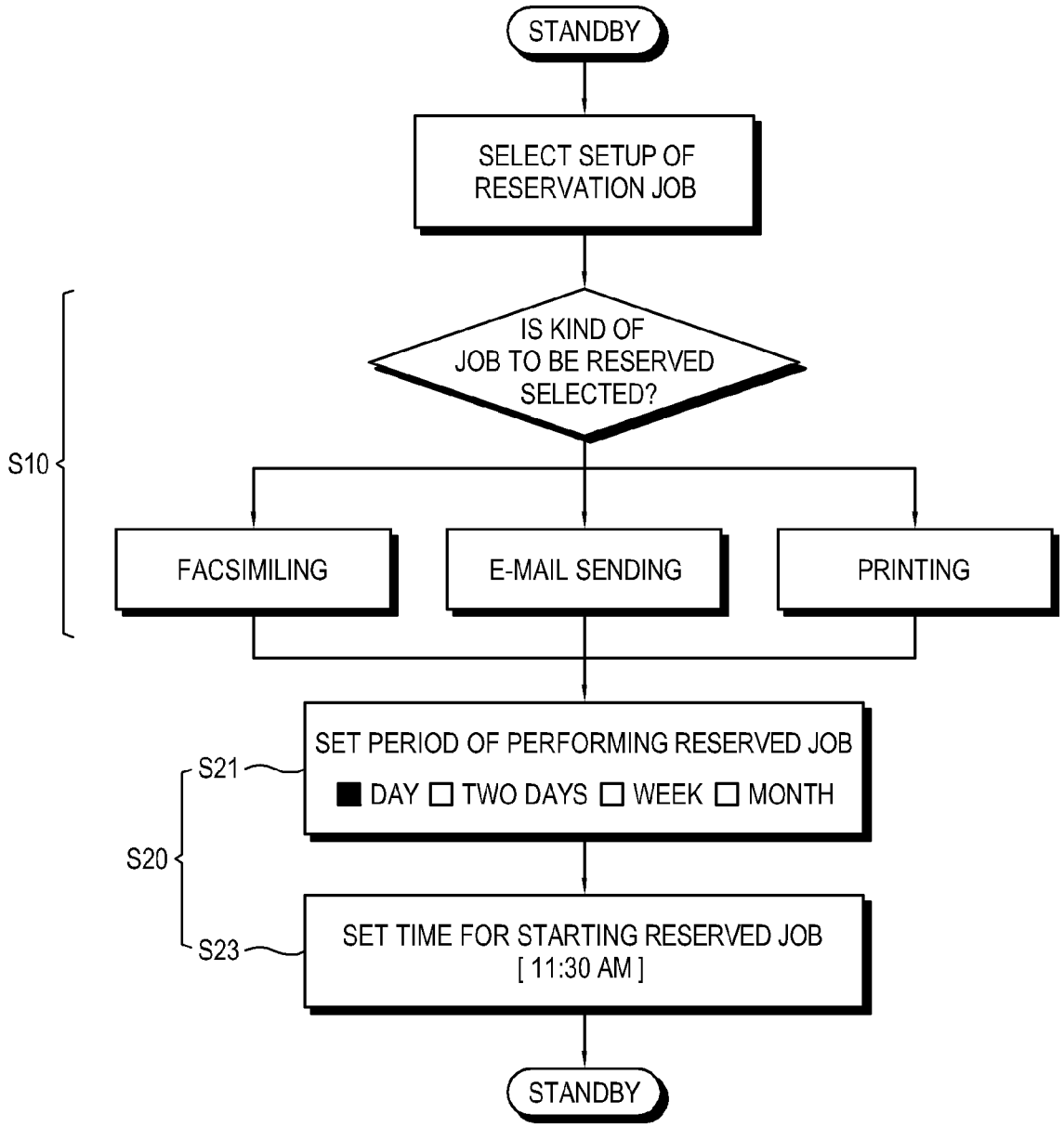
FIG. 4 is a flowchart illustrating a process for selecting a job and a process for setting a time for starting and a period for performing a reserved job according to the job reservation method of FIG. 3.

Further, as shown in FIG. 4, the operation S20 includes setting the period of performing the reserved job periodically at operation S21, and setting a time for starting the reserved time S23, thereby allowing the reserved job to be performed periodically. The operation S20 may be performed individually with regard to each of the folders if the storing unit includes the plurality of folders. As to the time for starting and the period of performing the reserved job, the plurality of folders may be set independently of each other, so that a user can diversely reserve the periodic job as desired.

Referring back to FIG. 3, the operations S30 and S40 are performed after the kind of job is selected and its starting time and performing period are set at the operations S10 and S20.

In more detail, at an operation S31 the controller of the image forming apparatus or the host may determine whether a current time equals the set starting time and the performing period of the reserved job. At the operation S31, if the current time reaches the set starting time and the period for performing of the reserved job, the operation S40 is implemented. On the other hand, if the current time does not reach the set starting time and the performing period of the reserved job, it is repeatedly determined as time progresses whether the current time equals the set starting time and the period until a termination order is input. However, aspects of the present invention are not limited thereto such that the reserved job may be performed any number of times, which may be determined within any period or may be determined when setting the starting time and the period for the reserved job.

At an operation S35, the controller of the image forming apparatus or the host may determine whether the job data is stored in the storing unit 40. Here, the operation of storing the job data in the storing unit 40 includes selecting a document file to be stored, and storing the selected document in the corresponding folder of the storing unit 40. The document is selected between an image data file scanned through the scanning part 23 or a document file stored in the storing unit 40 of the image forming apparatus 1 or the host 50.

If it is determined that the job data is stored in the storing unit 40 at the operation S35, the facsimiling, the e-mail sending, the printing, or the like is applied to the stored job data according to the selected kind of job at the operation S40.

On the other hand, if it is determined that there is no stored job data at the operation S35, it is determined whether to terminate the job or not without implementing the operation S40. Aspects of the present invention are not limited to the methods illustrated in FIGS. 3 and 4 such that if the controller 10 of the image forming apparatus 1 or the host 50 determines that there is no stored job data, the image forming apparatus 1 or the host 50 may issue an alert, such as an email, print out, audible, or visual alert to a user. Further, if the expected job data corresponds to a user having input an identification and a password, such an alert may be issued to the authenticated user.

According to the foregoing job reservation method for the image forming apparatus, if the fax sending, the e-mail sending, the printing, etc. is to be reserved periodically, the reservation job is achieved by storing the job data in the folder assigned to the certain kind of job without setting the reservation job each time such reservation job is to be performed, thereby enhancing a user's convenience.

As described above, aspects of the present invention provide an image forming apparatus, an image processing system having the same, and a method for performing a reservation job of the image forming apparatus, in which folders are provided in a storing unit to store job data according to the kinds of jobs, and a time for starting and a period for performing a reserved job are previously set so that a reservation job is easily performed by storing the job data in the folder assigned according to the kinds of jobs, thereby improving a user's convenience.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A method for performing a reservation job of an image forming apparatus, the method comprising:

selecting a plurality of different kinds of jobs that can be applied to reserved job data;

setting a time for starting and a period for performing a selected job applying the reserved job data, the period for performing the selected job being a unit of time in which the selected job is performed once during the period; and performing the selected job at the set time within each period, wherein the setting of the time for starting and the period for performing the selected job comprises setting the time for starting and the period for performing the selected job individually for each of the plurality of the different kinds of jobs.

2. The method of claim 1, further comprising storing the job data to be performed at the set time according to the set period.

3. The method of claim 2, wherein the storing of the job data comprises storing the job data in at least one of the image forming apparatus, a portable storage medium connected to the image forming apparatus, and a host connected to the image forming apparatus.

4. The method of claim 3, wherein the storing of the job data comprises storing the job data in folders according to the plurality of the different kinds of jobs.

5. The method of claim 4, wherein the kinds of jobs stored in the folders comprises at least one of sending a facsimile, sending e-mail, and printing.

6. The method of claim 4, further comprising:

setting detailed information according to the kinds of jobs.

7. The method of claim 6, wherein at least one of the image forming apparatus, the portable storage medium, and the host checks the detailed description and the kind of job assigned to the folder through an attribute file stored in the folder, and performs the reserved job according to the kind of job and the detailed information.

8. The method of claim 6, wherein at least one of the selecting the kinds of jobs, the setting the time for starting and the period for performing the reserved job, and the setting the detailed information is performed through a user interface provided in the host.

9. The method of claim 1, further comprising authenticating a user to allow only the authenticated user to have authority to select the kinds of jobs and to set the time for starting and the period for performing the reserved job.

10. An image forming apparatus, comprising:

a job selecting unit to select a plurality of different kinds of jobs that can be applied to reserved job data;

a period setting unit to set a time for starting and a period for performing a selected job applied to the reserved job data, the period for performing the selected job being a unit of time in which the selected job is performed once during the period;

a controller to control the selected job to be performed at the set time within each period; and a storing unit to store the job data, wherein the period setting unit is configured to set the time for starting and the period for performing the selected job by setting the time for starting and the period for performing the selected job individually for each of the plurality of the different kinds of jobs.

11. The apparatus of claim 10, wherein the storing unit stores the job data in a folder in at least one of the image forming apparatus, a portable storage medium connected to the image forming apparatus, and a host connected to the image forming apparatus.

12. The apparatus of claim 11, wherein the storing unit respectively stores the job data in a plurality of the folders according to the kinds of jobs.

13. The apparatus of claim 12, wherein the period setting unit sets the time for starting and the period for performing the reserved jobs according to the plurality of folders, respectively.

14. The apparatus of claim 11, wherein the kinds of jobs to be selected and stored in the folders by the job selecting unit comprise at least one of sending a fax, sending e-mail, and printing.

15. The apparatus of claim 14, further comprising: a detailed information setting unit to set detailed information according to the kinds of jobs.

16. The apparatus of claim 10, further comprising: a user authenticating unit to authenticate a user to allow only the authenticated user to select the kinds of jobs and to set the time for starting and the period for performing the reserved job.

17. The apparatus of claim 10, further comprising a printing part to output the reserved job data on a printing medium when a current time equals the set time and period.

18. An image processing system, comprising:

an image forming apparatus according to claim 10; and a host to control the image forming apparatus.

19. The image processing system of claim 18, wherein the storing unit stores the job data in a folder in at least one of the image forming apparatus, a portable storage medium connected to the image forming apparatus, and the host connected to the image forming apparatus.

20. The image processing system of claim 19, wherein the storing unit respectively stores the job data in a plurality of the folders according to the kinds of jobs.

21. The image processing system of claim 20, wherein the period setting unit sets the time for starting and the period for performing the reserved jobs according to the plurality of folders, respectively.

22. The image processing system of claim 19, wherein the kinds of jobs to be selected and stored in the folders by the job selecting unit comprises at least one of sending a fax, sending e-mail, and printing.

23. The image processing system of claim 22, further comprising: a detailed information setting unit to set detailed information according to the kinds of jobs.

24. The image processing system of claim 18, further comprising a user authenticating unit to authenticate a user to allow only the authenticated user to select the kinds of jobs and to set the time for starting and the period for performing the reserved job.

25. A method for performing a job on an apparatus, the method comprising:

selecting a plurality of different kinds of jobs that can be applied to job data;

storing the job data in different folders based on the selected plurality of different kinds of jobs; and setting a time for starting and a period for performing a selected job, the period for performing the selected job being a unit of time in which the selected job is performed once during the period.

* * * * *